US010544798B2

(12) United States Patent
Horng et al.

(10) Patent No.: US 10,544,798 B2
(45) Date of Patent: Jan. 28, 2020

(54) FLOW GUIDING DEVICE FOR A FAN

(71) Applicant: Sunonwealth Electric Machine Industry Co., Ltd., Kaohsiung (TW)

(72) Inventors: Alex Horng, Kaohsiung (TW); Tso-Kuo Yin, Kaohsiung (TW); Cheng-Wei Lin, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 15/871,390

(22) Filed: Jan. 15, 2018

(65) Prior Publication Data

US 2019/0072107 A1 Mar. 7, 2019

(30) Foreign Application Priority Data

Sep. 4, 2017 (TW) ..... 106130185 A

(51) Int. Cl.
*F04D 29/38* (2006.01)
*F04D 25/08* (2006.01)
*F04D 29/34* (2006.01)

(52) U.S. Cl.
CPC ..... *F04D 29/388* (2013.01); *F04D 25/088* (2013.01); *F04D 29/34* (2013.01)

(58) Field of Classification Search
CPC ..... F04D 25/088; F04D 29/34; F04D 29/384; F04D 29/388; F04D 29/681
USPC ..... 416/146 R
See application file for complete search history.

(56) References Cited

U.S. PATENT DOCUMENTS 871,729 A 11/1907 McChord, Jr.
7,252,478 B2 * 8/2007 Aynsley ..... F03B 17/063 416/204 R
D587,799 S 3/2009 Oleson
2016/0290357 A1 * 10/2016 Whitley ..... F04D 29/388

* cited by examiner

*Primary Examiner* — Igor Kershteyn
(74) *Attorney, Agent, or Firm* — Alan D. Kamrath; Karin L. Williams; Mayer & Williams PC

(57) ABSTRACT

A flow guiding device includes a flow-guiding member and a blade. The flow-guiding member includes a flow-guiding portion, a neck portion and a first coupling portion. The flow-guiding portion is connected to a first end of the neck portion. The first coupling portion is located at a second end of the neck portion. The flow-guiding portion, the neck portion and the first coupling portion are connected in series in a radial direction. The blade includes a second coupling portion at a free end of the blade. The second coupling portion is coupled with the first coupling portion. The flow-guiding portion has a cross-sectional area smaller than or equal to a cross-sectional area of the blade. A cross-sectional area of the neck portion viewed from the radial direction at the first end is smaller than a cross-sectional area of the neck portion viewed from the radial direction at the second end.

11 Claims, 6 Drawing Sheets

FLOW GUIDING DEVICE FOR A FAN

CROSS REFERENCE TO RELATED APPLICATIONS

The application claims the benefit of Taiwan application serial No. 106130185, filed on Sep. 4, 2017, and the entire contents of which are incorporated herein by reference.

BACKGROUND OF THE INVENTION

1. Field of the Invention

The present invention generally relates to a flow guiding device for a fan and, more particularly, to a flow guiding device for a fan which is able to reduce the vortex at the tips (free ends) of the blades and to improve the rotational efficiency of the fan.

2. Description of the Related Art

During the rotation of a blade of a fan, a pressure difference existing between the top and bottom surfaces of the blade causes the air to flow around the tip of the blade from the high-pressure area to the low-pressure area while flowing through the tip of the blade in a tangential direction. Due to the combination of these two types of the air flow patterns, a spiral vortex movement is formed called a "tip vortex."

The tip vortex generated by a large machinery usually causes interference or even destruction to the environment, whereas a general fan usually does not create damage due to a smaller operational power. However, the general fan may generate noise due to a rotating blade strongly cutting through the tip vortex generated by the preceding blade, adversely affecting the operational stability of the fan.

In light of this, a conventional winglet can be mounted to the tip of the blade to increase the path that the air flows around the blade from the top surface to the bottom surface of the blade. This can reduce the amount of the air flowing around the tip of the blade and therefore reduce the vortex effect.

However, the use of such a winglet increases the weight, and the increase in surface area leads to an increased friction, lowering the operational efficiency of the blade.

In light of this, it is necessary to improve the conventional flow guiding device.

SUMMARY OF THE INVENTION

It is therefore the objective of this invention to provide a flow guiding device which reduces the air friction and the load of the motor of the fan, thereby improving the operational efficiency of the fan.

It is another objective of this invention to provide a flow guiding device which can mitigate the vortex by reducing the amount of the air flowing around the blade while converting the flow of air into rotational power.

In an embodiment, a flow guiding device including a flow-guiding member and a blade is disclosed. The flow-guiding member includes a flow-guiding portion, a neck portion and a first coupling portion. The flow-guiding portion is connected to a first end of the neck portion. The first coupling portion is located at a second end of the neck portion. The flow-guiding portion, the neck portion and the first coupling portion are connected in series in a radial direction. The blade includes a second coupling portion at a free end of the blade. The second coupling portion is coupled with the first coupling portion. The flow-guiding portion has a cross-sectional area viewed from the radial direction smaller than or equal to a cross-sectional area of the blade viewed from the radial direction. A cross-sectional area of the neck portion viewed from the radial direction at the first end is smaller than a cross-sectional area of the neck portion viewed from the radial direction at the second end.

Based on this, the flow guiding device according to the invention has a reduced surface area to reduce the air friction, as well as a reduced weight of the blades to reduce the load of the motor. Thus, the rotational efficiency can be enhanced while the amount of the air flowing around the blade is reduced to mitigate the tip vortex.

In an example, the cross-sectional area of the neck portion viewed from the radial direction at the first end is smaller than the cross-sectional area of the flow-guiding portion viewed from the radial direction. In this arrangement, the flow-guiding portion can hinder the air from flowing around the blade, mitigating the tip vortex.

In the example, the neck portion is in a conical shape which gradually reduces from the second end to the first end. In this arrangement, the weight of the flow-guiding member and the surface area of the flow-guiding portion are reduced to improve the rotational efficiency of the fan.

In the example, the blade has a first face and a second face opposite to the first face, a reference plane is defined to extend through the first face of the blade, and a face of the neck portion that connects to the first face of the blade is inclined from the reference plane by an elevation angle in a direction away from the second face of the blade. In this arrangement, the location where the air flows around the blade can be changed, transforming the air which flows around the blade into a propelling force.

In another example, the blade has a first face and a second face opposite to the first face, a reference plane is defined to extend through the first face of the blade, and a face of the neck portion that connects to the first face of the blade is inclined from the reference plane by a depression angle in a direction approaching the second face of the blade. In the arrangement, the location where the air flows around the blade can be changed, transforming the air which flows around the blade into a propelling force.

In another example, the blade has a first edge and a second edge, and the flow-guiding portion has a first side connected to the first edge and a second side connected to the second edge. A reference plane is defined to extend through the first edge of the blade, and the first side of the flow-guiding portion is inclined from the reference plane by an angle. In this arrangement, the flow-guiding portion is inclined from the blade to disperse the force acted radially upon the blade generated by the air flowing around the blade, reducing the impact to the blade.

In the other example, the first side of the flow-guiding portion is inclined from the reference plane by an angle in a rotating direction of the blade. In this arrangement, the air which flows around the blade can be transformed into a tangential force.

In the further example, the first side of the flow-guiding portion is inclined from the reference plane by an angle in a direction opposite to a rotating direction of the blade. In this arrangement, the air which flows around the blade can be transformed into a tangential force.

In the example, the blade is hollow. In this arrangement, the moment of inertia during the operation of the fan can be reduced, improving the rotational efficiency of the fan and reducing the structural fatigue thereof.

In the example, the blade includes at least one supporting rib therein. In this arrangement, the structural strength of the blade can be increased.

In the example, a cross section of the flow-guiding portion viewed from the radial direction has a same outline as a cross section of the blade viewed from the radial direction. In this arrangement, the air can have a consistent flow path when flowing through the flow-guiding portion and the blade, stabilizing the rotation.

In the example, the blade further include an inner end opposite to the free end. The inner end of the blade is configured to connect to a rotor of a motor of a ceiling fan. In this arrangement, the rotational efficiency of the ceiling fan can be improved and the vortex can be reduced.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
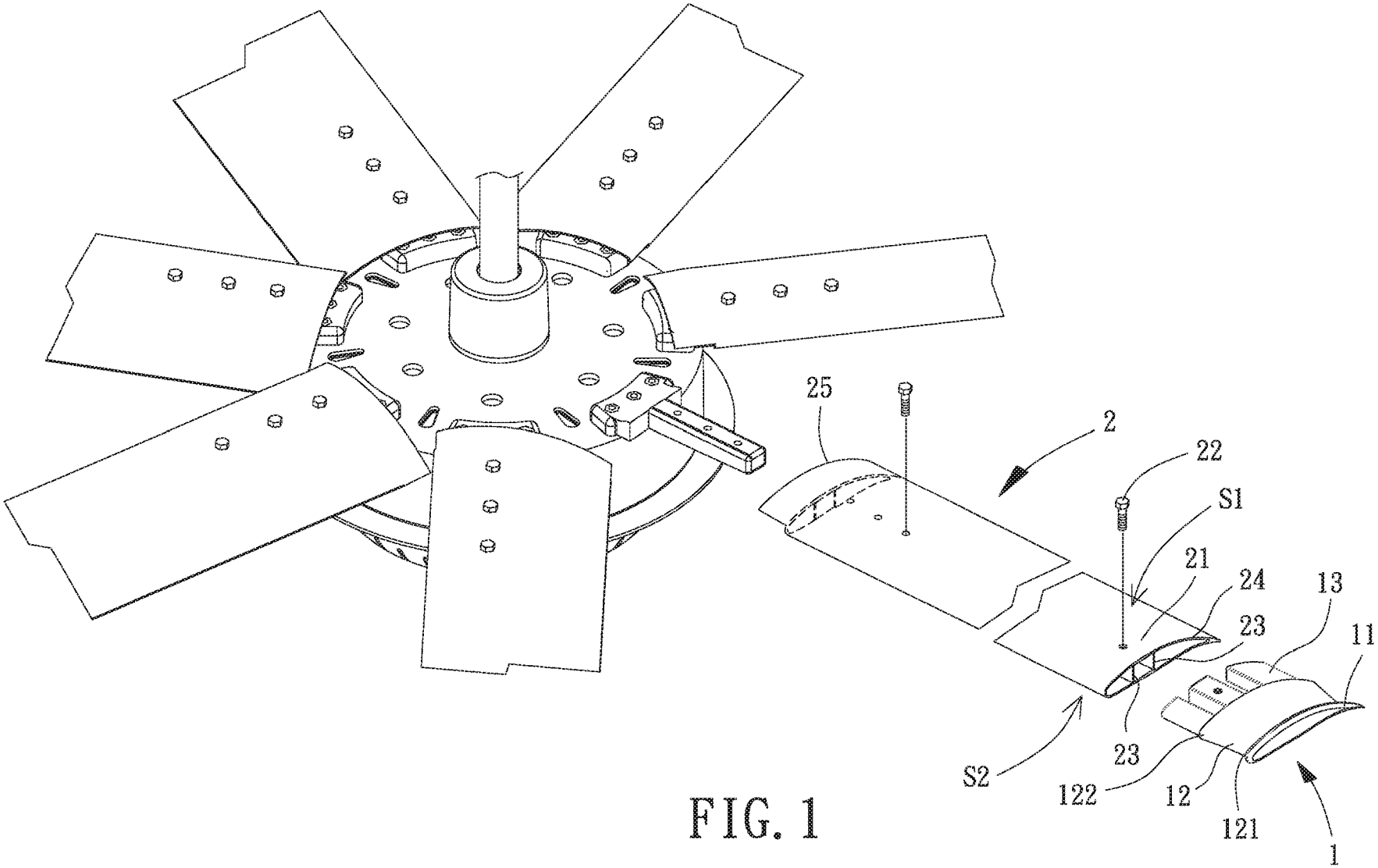
FIG. 1 is a perspective view of a flow guiding device for a fan according to a first embodiment of the invention.

In the various figures of the drawings, the same numerals designate the same or similar parts. Furthermore, when the terms "first", "second", "radial" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

FIG. 1 shows a flow guiding device for a fan according to a first embodiment of the invention. The flow guiding device includes a plurality of flow-guiding members 1 and a plurality of blades 2. Each blade 2 includes a free end 24 connected to a respective flow-guiding member 1 and inner end 25 connected to a rotor of a motor. The flow-guiding members 1 and the blades 2 jointly rotate with the rotor.

Each flow-guiding member 1 includes a flow-guiding portion 11, a neck portion 12 and a first coupling portion 13. The neck portion 12 includes a first end 121 connected to a respective flow-guiding portion 11 and a second end 122 connected to the first coupling portion 13.

Each blade 2 includes a second coupling portion 21 at a tip thereof. The first coupling portion 13 is fixed to the second coupling portion 21. In this embodiment, the first coupling portion 13 includes a plurality of tenons, and the second coupling portion 21 includes a plurality of mortises. The first coupling portion 13 is connected to the second coupling portion 21. A fixing member 22 is used to fix the first coupling portion 13. However, the connection is not limited to the above. The blade 2 includes a first face S1 and a second face S2 opposite to the first face S1.

Figure 2A:
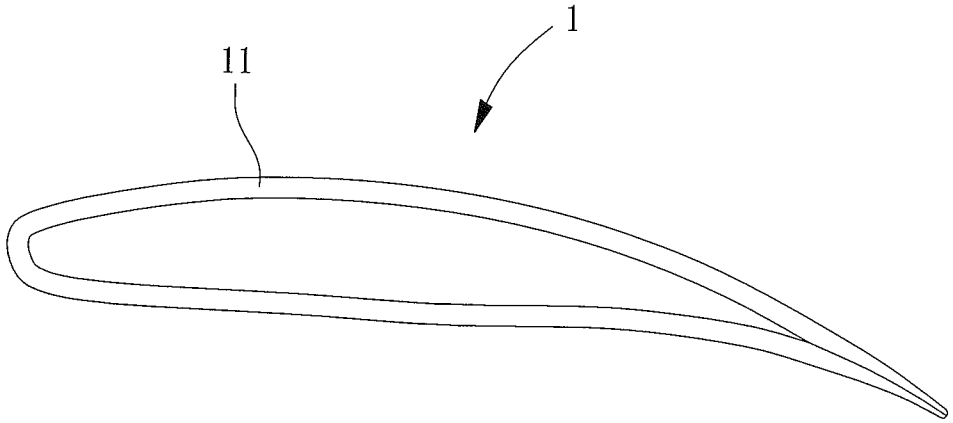
FIG. 2*a* is an end view of a flow-guiding portion of the flow guiding device.
Figure 2B:
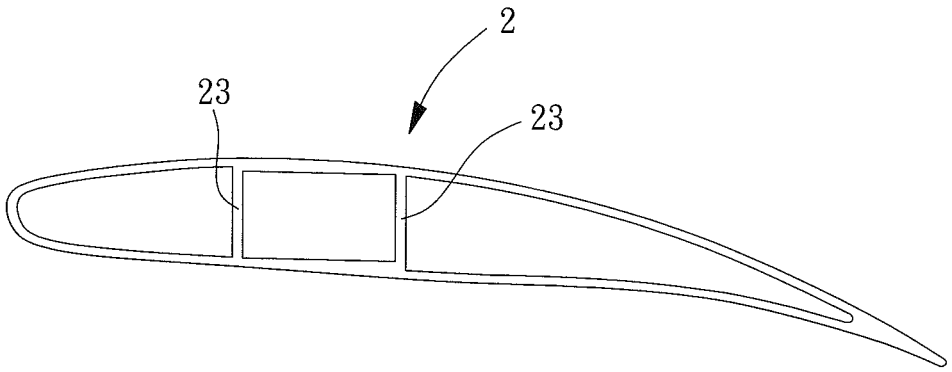
FIG. 2*b* is an end view of a blade of the flow guiding device.

FIG. 2*a* is an end view of the flow-guiding portion 11. FIG. 2*b* is a cross-sectional view of the blade 2. The flow-guiding portion 11 has a cross-sectional area not larger than that of the blade 2 in order to attain a reduced volume and a reduced surface area. The cross sections of the flow-guiding portion 11 and the blade 2 preferably have the same outline.

Figure 3:
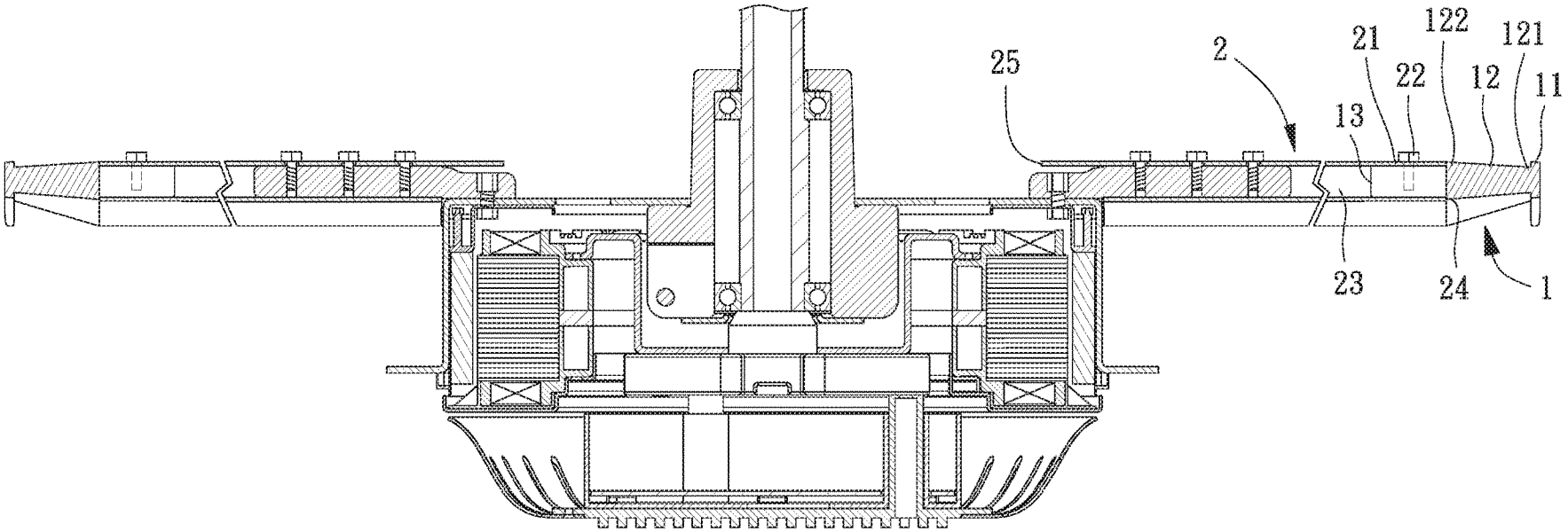
FIG. 3 is a cross-sectional view of a ceiling fan using the flow guiding device of the first embodiment of the invention.

Referring to FIG. 3, the neck portion 12 forms a conical shape which gradually reduces from the second end 122 towards the first end 121 in the radial direction. For example, the neck portion 12 extends in a desired degree of inclination to form a straight cone or an oblique cone. Thus, the neck portion 12 has a smaller cross-sectional area at the first end 121 than at the second end 122. The cross section of the neck portion 12 at the first end 121 is also smaller than the cross section of the flow-guiding portion 11. In the above structure, the volume and weight of the flow-guiding member 1 can be further reduced. The outline of the cross section of the neck portion 12 at the second end 122 preferably has the same size and shape as the outline of the cross section of the tip of the blade 2. In this structure, the flow-guiding member 1 and the blade 2 can completely fit to each other after the first coupling portion 13 is coupled with the second coupling portion 21. As a result, the air can flow more smoothly.

Preferably, both the flow-guiding member 1 and the blade 2 are hollow to reduce the moment of inertia. In this manner, the same rotational speed can be achieved with a smaller power. Also, the abrasion and fatigue of each interconnected part of the blade 2 can be reduced. However, the blade 2 preferably includes at least one supporting rib 23 to reinforce the structural strength of the blade 2 and to prevent the tip of the blade 2 from drooping.

Figure 4:
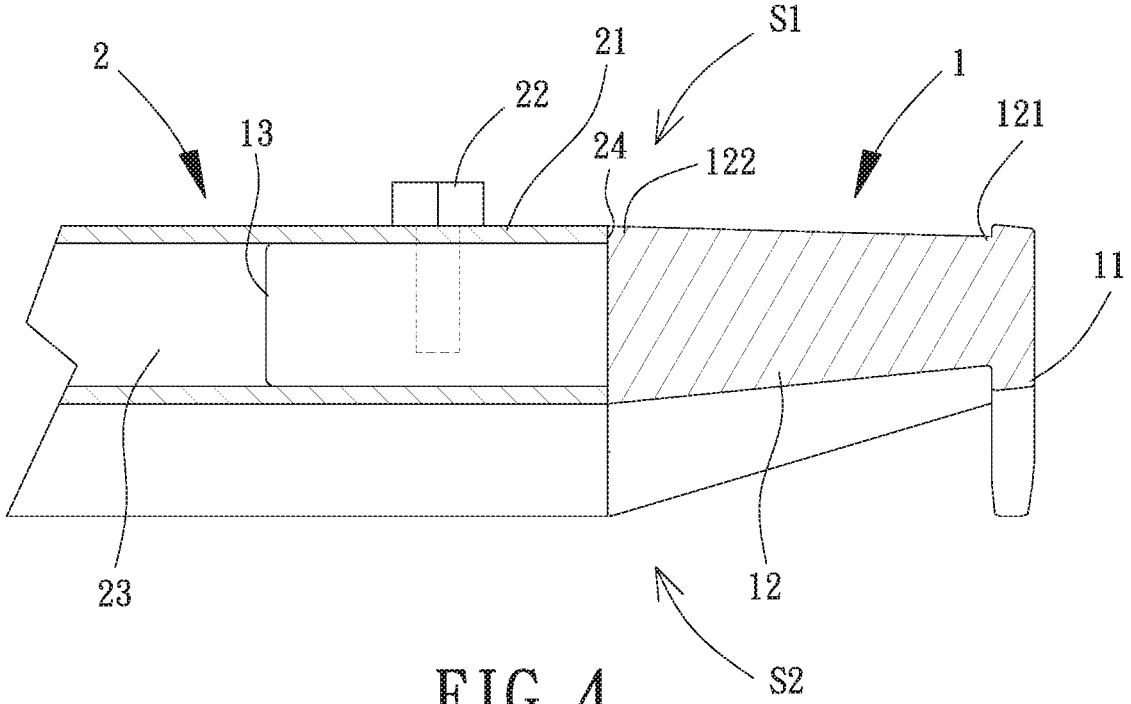
FIG. 4 is a partially enlarged view of FIG. 3.

Based on the above structure, referring to FIG. 4, when the motor operates to drive the blades 2 to rotate, the air flows through the first face S1 and the second face S2. The air flows from a high-pressure area to a low-pressure area according to fluid mechanics. Therefore, when the pressure on the first face S1 is smaller than that on the second face S2, the air near the second face S2 tends to flow around the blade 2 and towards the first face S1. In addition, during the rotation, a great amount of air passes through the first face S1 and the second face S2 in a direction opposite to the rotating direction of the blades 2. Thus, the only area that the air is able to flow around the blade 2 from the second face S2 to the first face S1 is the tip of the blade 2 and the flow-guiding member 1. Since the neck portion 12 of the flow-guiding member 1 gradually reduces towards the first end 121 and the flow-guiding portion 11 and since the flow-guiding portion 11 has a larger cross-sectional area than the first end 121 of the neck portion 12, the amount of the air flowing around the flow-guiding member 1 can be effectively reduced.

Figure 5:
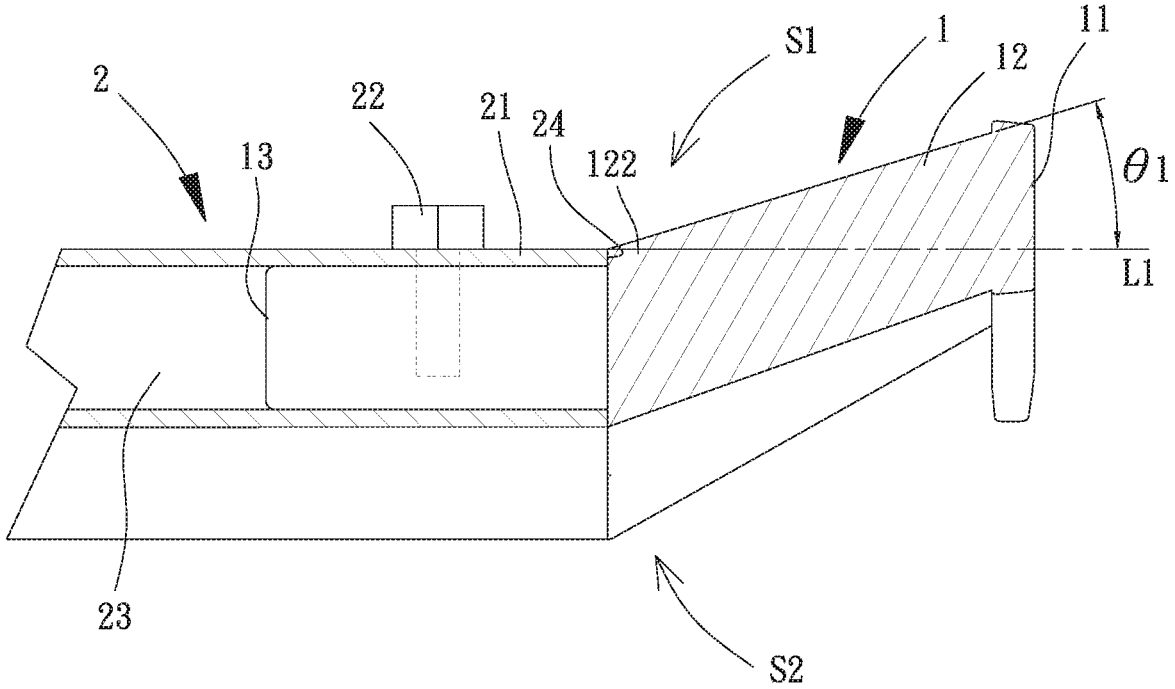
FIG. 5 is a cross-sectional, partially enlarged view of a flow guiding device according to a second embodiment of the invention.

FIG. 5 shows a flow guiding device for a fan according to a second embodiment of the invention. As compared with the first embodiment, there is an elevation angle θ1 in a cross section of the flow guiding device. The elevation angle θ1 is preferably an acute angle. Specifically, a reference plane L1 is defined to extend through the first face S1 of the blade 2. In this regard, the face of the neck portion 12 that connects to the first face S1 of the blade 2 is inclined from the reference plane L1 by the elevation angle θ1 in a direction away from the second face S2 of the blade 2. Due to the elevation angle θ1, the path of the air flowing through the neck portion 12 to the flow-guiding portion 11 can be changed. This can change the location where the air flows around the blade 2. In other words, this arrangement makes the vortex take place in a location outwardly of the flow-guiding portion 11, creating a force acting towards the center of the fan. As a result, the flow-guiding portion 11 can convert a part of the force into a propelling force for driving the blades 2. The rotational efficiency of the fan is improved.

Figure 6:
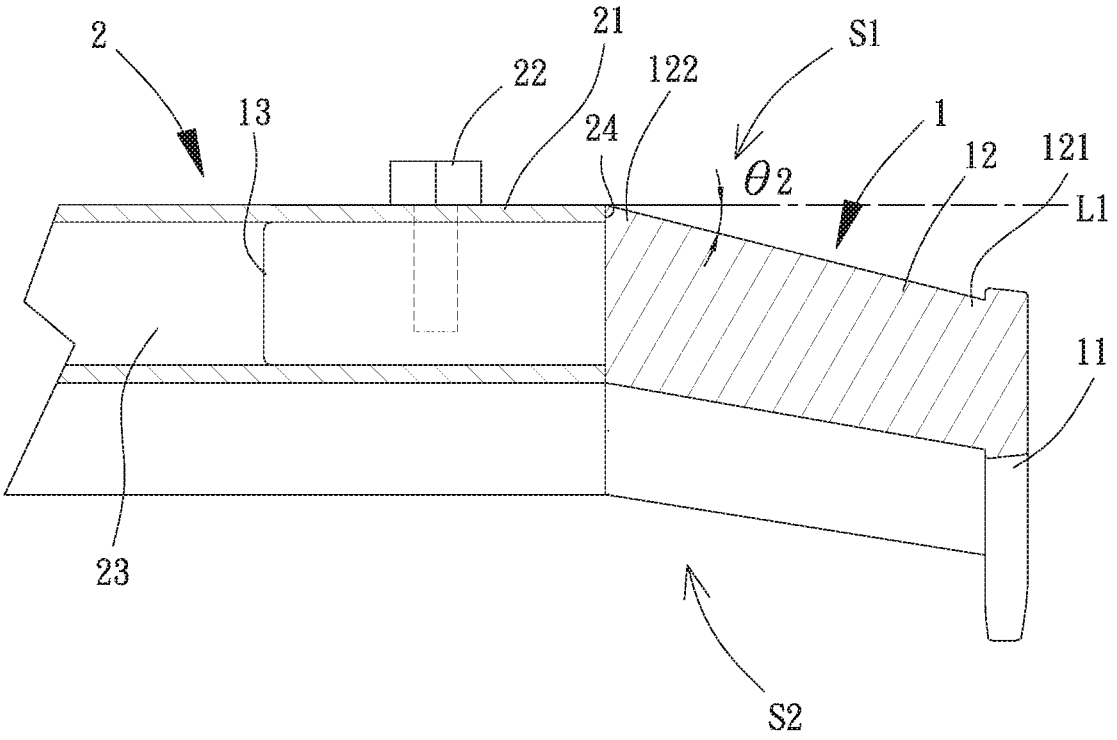
FIG. 6 is a cross-sectional, partially enlarged view of a flow guiding device according to a third embodiment of the invention.

FIG. 6 shows a flow guiding device for a fan according to a third embodiment of the invention. As compared with the first embodiment, there is a depression angle θ2 in a cross section of the flow guiding device. The depression angle θ2 is preferably an acute angle. Specifically, the face of the neck portion 12 that connects to the first face S1 of the blade 2 is inclined from the reference plane L1 by the depression angle θ2 in a direction approaching the second face S2 of the blade 2. Due to the depression angle θ2, the path of the air flowing through the neck portion 12 and the flow-guiding portion 11 can be changed. This can change the location where the vortex takes place. Thus, the vortex can be transformed into a propelling force for driving the blades 2 to rotate, improving the rotational efficiency of the fan.

Figure 7:
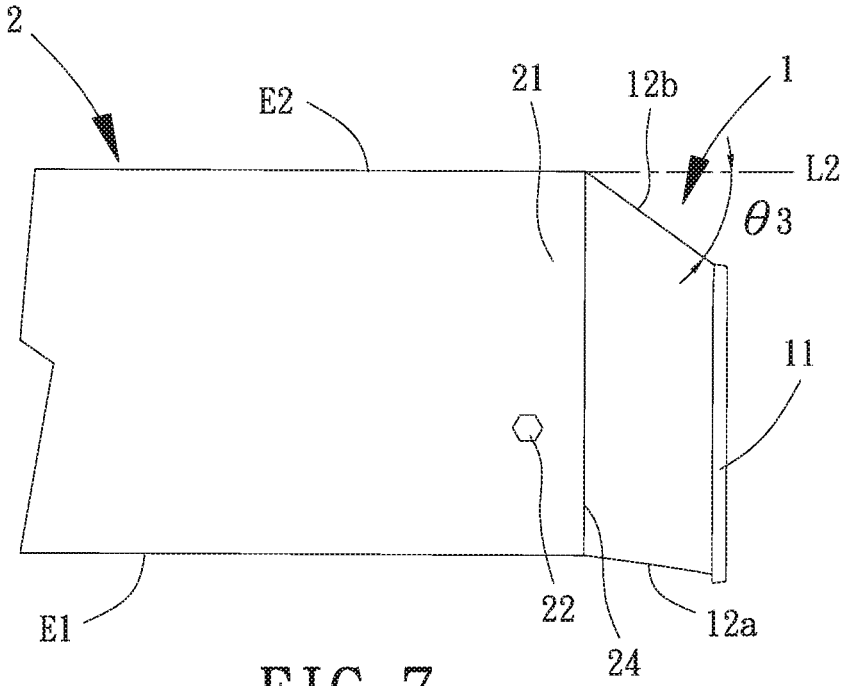
FIG. 7 is a partially-enlarged top view of a flow guiding device including a neck portion having a trailing edge extending in an inclined manner.
Figure 8:
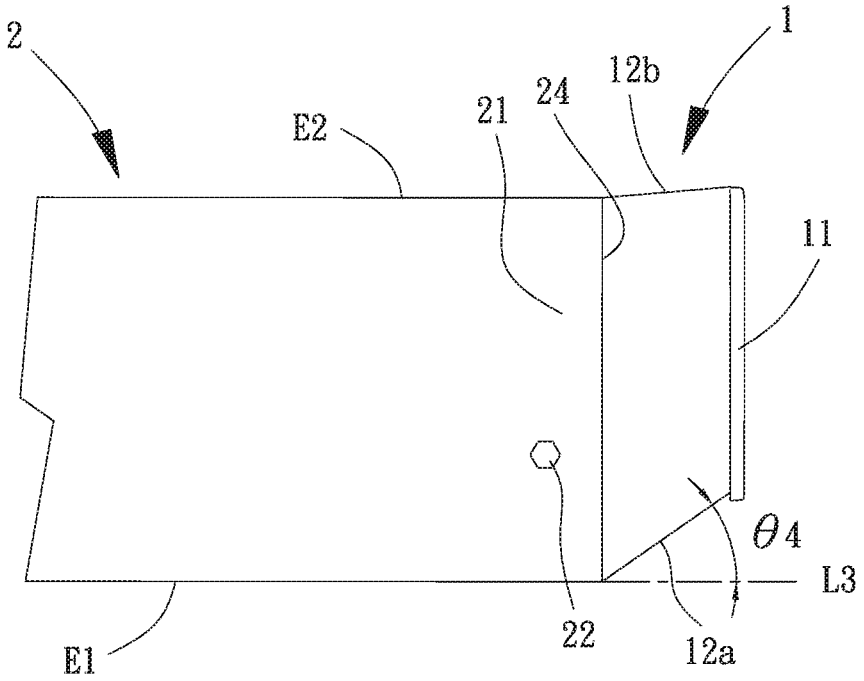
FIG. 8 is a partially-enlarged top view of a flow guiding device including a neck portion having a leading edge extending in an inclined manner.

Referring to FIGS. 7 and 8, there may be an angle between the neck portion 12 and the blade 2 in a cross section of the blade 2. Specifically, in a top view of the flow-guiding member 1, the blade 2 includes a first edge E1 and a second edge E2, and the neck portion 12 has a first side 12*a* connected to the first edge E1 and a second side 12*b* connected to the second edge E2. Assume the blade 2 rotates in a clockwise direction, and a reference plane L2 is defined to extend through the second edge E2 of the blade 2. In this situation, in the rotating direction of the blade 2, the first edge E1 of the blade 2 serves as a leading edge and precedes the second edge E2 that serves as a trailing edge. In this case, the first side 12*a* of the neck portion 12 serves as a leading side and precedes the second side 12*b* that serves as a trailing side. In this regard, the second side 12*b* of the neck portion 12 is inclined from the reference plane L2 by an angle θ3 in the rotating direction of the blade 2. Referring to FIG. 7, the cross-sectional area of the flow-guiding portion 11 is equal to or smaller than the cross-sectional area of the blade 2. Alternatively, a reference plane L3 is defined to extend through the first edge E1 of the blade 2, and the first side 12*a* of the neck portion 12 is inclined from the reference plane L3 by an angle θ4 in a direction opposite to the rotating direction of the blade 2, as shown in FIG. 8. In this regard, the cross-sectional area of the flow-guiding portion 11 is also equal to or smaller than the cross-sectional area of the blade 2.

The flow guiding device according to the invention can be mounted to a motor of a ceiling fan. In this situation, two ends of the blade 2 are connected to the flow-guiding member 1 and the rotor of the ceiling fan, respectively. This can improve the rotational efficiency of the ceiling fan and reduce the vortex during the rotation of the ceiling fan.

In summary, the flow guiding device according to the invention is designed with a reduced surface area to reduce the air friction, as well as a reduced weight of the blades to reduce the load of the motor. Thus, the rotational efficiency can be enhanced and even the vortex can be used to facilitate the rotation of the motor.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A flow guiding device comprising:

a flow-guiding member including a flow-guiding portion, a neck portion and a first coupling portion, wherein the flow-guiding portion is connected to a first end of the neck portion, wherein the first coupling portion is located at a second end of the neck portion, wherein the flow-guiding portion, the neck portion and the first coupling portion are connected in series in a radial direction, wherein the neck portion has a conical shape which gradually reduces from the second end to the first end, and wherein a length of the neck portion in a radial direction is longer than a length of the flow-guiding portion in a radial direction; and a blade including a second coupling portion at a free end of the blade, wherein the second coupling portion is coupled with the first coupling portion, wherein the flow-guiding portion has a cross-sectional area perpendicular to the radial direction smaller than or equal to a cross-sectional area of the blade perpendicular to the radial direction, and wherein a cross-sectional area of the neck portion perpendicular to the radial direction at the first end is smaller than a cross-sectional area of the neck portion perpendicular to the radial direction at the second end.

2. The flow guiding device as claimed in claim 1, wherein the cross-sectional area of the neck portion perpendicular to the radial direction at the first end is smaller than the cross-sectional area of the flow-guiding portion perpendicular to the radial direction.

3. The flow guiding device as claimed in claim 1, wherein the blade has a first face and a second face opposite to the first face, wherein a reference plane is defined to extend through the first face of the blade, and wherein a face of the neck portion that connects to the first face of the blade is inclined from the reference plane by an elevation angle in a direction away from the second face of the blade.

4. The flow guiding device as claimed in claim 1, wherein the blade has a first face and a second face opposite to the first face, wherein a reference plane is defined to extend through the first face of the blade, and wherein a face of the neck portion that connects to the first face of the blade is inclined from the reference plane by a depression angle in a direction approaching the second face of the blade.

5. The flow guiding device as claimed in claim 1, wherein the blade has a first edge and a second edge, and the flow-guiding portion has a first side connected to the first edge and a second side connected to the second edge, wherein a reference plane is defined to extend through the first edge of the blade, and wherein the first side of the flow-guiding portion is inclined from the reference plane by an angle.

6. The flow guiding device as claimed in claim 5, wherein the first side of the flow-guiding portion is inclined from the reference plane by an angle in a rotating direction of the blade.

7. The flow guiding device as claimed in claim 5, wherein the first side of the flow-guiding portion is inclined from the reference plane by an angle in a direction opposite to a rotating direction of the blade.

8. The flow guiding device as claimed in claim 1, wherein the blade is hollow.

9. The flow guiding device as claimed in claim 1, wherein the blade includes at least one supporting rib therein.

10. The flow guiding device as claimed in claim 1, wherein a cross section of the flow-guiding portion perpendicular to the radial direction has a same outline as a cross section of the blade perpendicular to the radial direction.

11. The flow guiding device as claimed in claim 1, wherein the blade further include an inner end opposite to the free end, and wherein the inner end of the blade is configured to connect to a rotor of a motor of a ceiling fan.

* * * * *